United States Patent [19]

Fuller

[11] 4,377,114

[45] Mar. 22, 1983

[54] HANGING STORAGE SHELF UNIT

[76] Inventor: R. Buckminster Fuller, 3501 Market St., Philadelphia, Pa. 19104

[21] Appl. No.: 308,245

[22] Filed: Oct. 5, 1981

[51] Int. Cl.[3] ..... A47B 9/00

[52] U.S. Cl. ..... 108/103; 211/113; 312/285; 108/149

[58] Field of Search ..... 108/103, 149, 94, 95; 312/283, 285, 245; 211/113, 114, 115, 116, 117, 118; 52/39; 248/328

[56] References Cited

U.S. PATENT DOCUMENTS

| | | | |
|---|---|---|---|
| 888,142 | 5/1908 | Bonesteel | 312/285 X |
| 1,029,709 | 6/1912 | Norrlander | 312/285 X |
| 1,272,273 | 7/1918 | Kell | 248/328 |
| 1,952,466 | 3/1934 | Sjodin et al. | 211/113 X |
| 2,281,849 | 5/1942 | McCoppin | 108/94 X |
| 3,080,583 | 3/1963 | Fuller . | |
| 3,257,154 | 6/1966 | Lewis | 312/285 X |
| 3,382,819 | 5/1968 | Deutsch et al. | 108/149 X |

*Primary Examiner*—Francis K. Zugel
*Assistant Examiner*—Peter A. Aschenbrenner
*Attorney, Agent, or Firm*—Parmelee, Bollinger & Bramblett

[57] ABSTRACT

The present invention provides hanging storage compartment apparatus with various shelf levels adapted to be suspended by a plurality of tension lines from an overhead structure, such as a ceiling. The storage apparatus includes at least one storage unit rotatably mounted to a suspended stationary member, such as a platform. Tension lines secured to the suspended member or platform are used to hang the storage apparatus from the overhead structure. A rotation bearing, such as a ball bearing ring, interposed between the suspended member or platform and the storage unit enables rotation of the storage unit relative to this suspended stationary member. In a further embodiment of the invention, upper and lower storage units, both of which are rotatable, may be mounted respectively above and below the suspended platform. A rotatable shaft passing through the suspended platform concentric with the rotation bearing, joins the upper and lower units so that rotation of either unit relative to the suspended platform simultaneously rotates the other unit by a corresponding amount. The weight of the storage shelves and contents keeps the suspension lines taut and thus provides overall stability. In another embodiment of the invention, a non-rotatable suspended storage shelf unit is hung from an overhead structure, such as a ceiling, so that the unit is positioned in a desired attractive location in a room, elevated above the floor.

11 Claims, 6 Drawing Figures

Fig. 5.
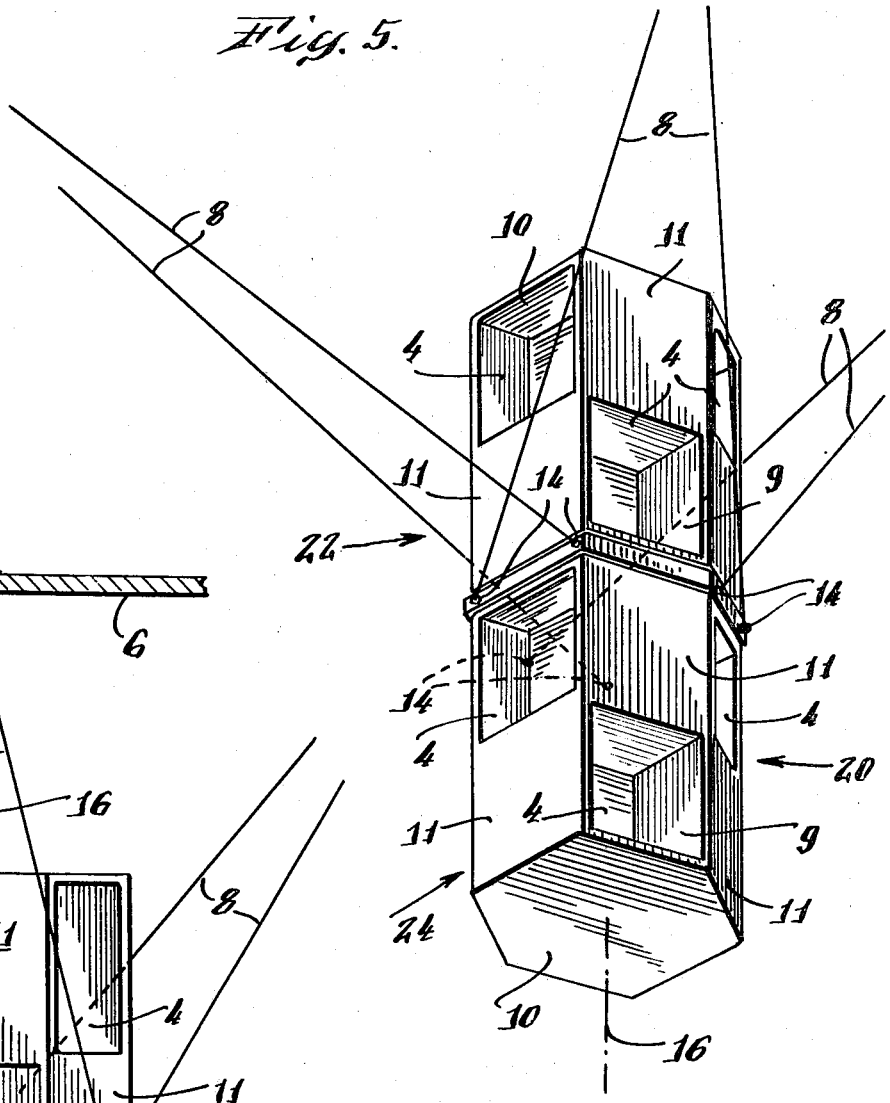
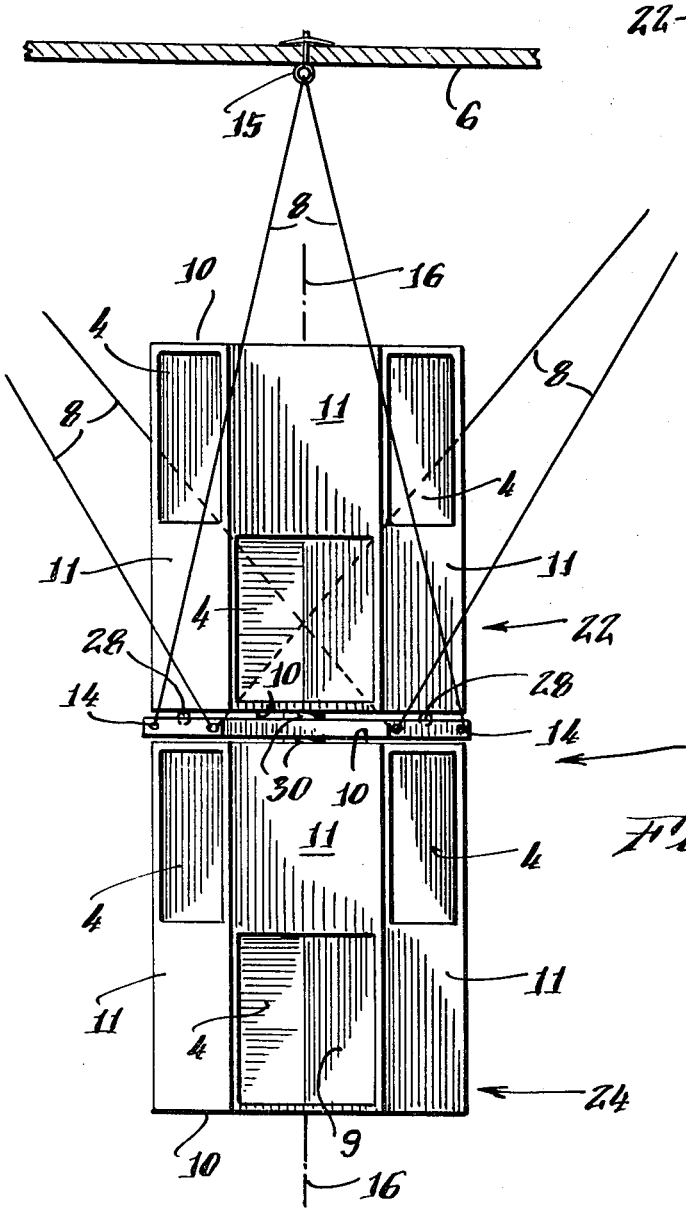
Fig. 6.

HANGING STORAGE SHELF UNIT

BACKGROUND OF THE INVENTION

The present invention relates to storage shelf apparatus adapted to be suspended from an overhead structure such as a ceiling. The shelf is suspended by a plurality of tension lines and the weight of the storage shelf and its contents keep these tension lines taut to provide the stability for the overall suspended structure. The storage shelf embodying the present invention is intended for use in homes and offices for the same purposes as conventional storage shelf units are now used.

Conventional storage units or shelves commonly used in homes or offices fall into two general categories. The first includes storage units or shelves supported directly on a lower supporting surface, such as a floor. A bookcase is a good example of this first type. The second includes storage units or shelves which are mounted above floor level by mounting to the side of a supporting structure, such as to a wall by brackets.

One disadvantage of such conventional storage units is that access to the interior of the unit is restricted to one side only. That is, storage units supported directly on a floor usually are designed so that entry therein is possible only from the front. The back of the unit is usually closed or abuts against a wall, rendering access through the back surface impossible. Likewise, access to a storage unit mounted to a wall by brackets can only be made through the front of the unit.

In addition to the restriction on access into conventional storage units, there is a problem of stability. With respect to the storage units supported directly on a floor, the taller the unit, the less stable it becomes. Often the top of a tall bookcase is fastened to a wall to prevent its leaning or falling away from the wall. Regarding the type of storage units mounted to a wall by brackets, the higher the unit is, the less stable it will be. A larger number of increasingly stronger brackets and wall anchors are required to support taller wall-mounted storage units of the latter type.

Moreover, both types of known storage units are generally positioned in a remote area of a room. Those mounted on a wall must, by necessity, be adjacent to the wall. Those supported on the floor are usually placed at the side or in the corner of the room to avoid occupying the limited floor space in the center of the room. Furthermore, many storage units are unattractive, thereby providing a further incentive for placing them in a remote location.

The present invention provides a suspended storage shelf unit of attractive appearance in which access to the various storage areas defined therein is available from all sides of the unit. The storage unit embodying one aspect of the present invention is rotatable relative to a suspended stationary member for the convenience of the user in selecting the specific portion of the unit through which access is desired. Because the unit is suspended by tension lines in an advantageous pattern, the forces resultant from gravitation exerted on the unit keep the unit stable. Additionally, the elevation of the storage unit can be selected by the user as desired by setting the length of the supporting tension lines.

In a further embodiment of the invention, a non-rotatable storage unit is suspended from an overhead structure such as a ceiling. This unit may be positioned such that it is centrally located in a room to provide access to its storage compartments from all sides. Because the unit is elevated, it does not occupy floor space in a room, and the weight of the unit keeps its supporting lines taut to enhance overall stability.

Accordingly, the suspended storage unit embodying the invention to be described herein overcomes the problems of access and stability inherent in the conventional type storage units discussed above and provides an attractive appearance.

SUMMARY OF THE INVENTION

The present invention is embodied in a storage unit defining storage compartments or shelves and adapted to be suspended from an overhead structure such as a ceiling, by tension lines. In one embodiment, the storage unit includes a suspended stationary member, such as a platform or flat ring, and at least one storage compartment is rotatably mounted to this suspended member. The suspended member includes means for securing the ends of the tension lines, such as cables or wires, for hanging the storage unit from a ceiling. Means are provided for allowing rotation of the storage compartment relative to the suspended stationary member, as for example, a ball-bearing ring, interposed between this member and the storage compartment and located in alignment with the axis of rotation.

In a further embodiment of the invention, an upper storage compartment is rotatably mounted above the suspended stationary member, while a lower storage compartment is rotatably mounted below this stationary member. A rotatable shaft passing through the suspended stationary member concentric with the rotation bearing means couples the upper storage compartment to the lower storage compartment. Accordingly, rotation of one of the compartments relative to the suspended stationary member simultaneously causes a corresponding degree of rotation of the other storage compartment.

In another embodiment of the invention, a hexagonal non-rotatable storage unit is suspended from an overhead structure, such as a ceiling. This unit may be suspended in a central location of the room, but by virtue of its elevated position, it does not occupy any floor space.

In all embodiments of the invention, the storage unit is suspended from an overhead structure by tension lines. By the advantageous interaction of three pairs of these tension lines in an equilateral triangular arrangement, the storage unit advantageously exhibits excellent stability. Moreover, access to the storage unit is available from all sides.

As used herein, the term "tension line" is intended to include any suitable wire, cable, strand or rope of strong, essentially non-stretchable material capable of supporting a heavy load under tension for an indefinitely long period of time without changing length, i.e., without "creeping" and without breaking.

Further features, aspects and advantages of the suspended storage unit will become more fully understood when the following description is considered in conjunction with the accompanying drawings.

BRIEF DESCRIPTION OF THE DRAWINGS

FIG. 5 is a perspective view of the hanging, rotatable storage compartment apparatus illustrated in FIG. 6;

FIG. 6 is a front elevational view illustrating hanging, rotatable storage compartment apparatus in accordance with another aspect of the present invention.

DESCRIPTION OF THE PREFERRED EMBODIMENTS

Figure 1:
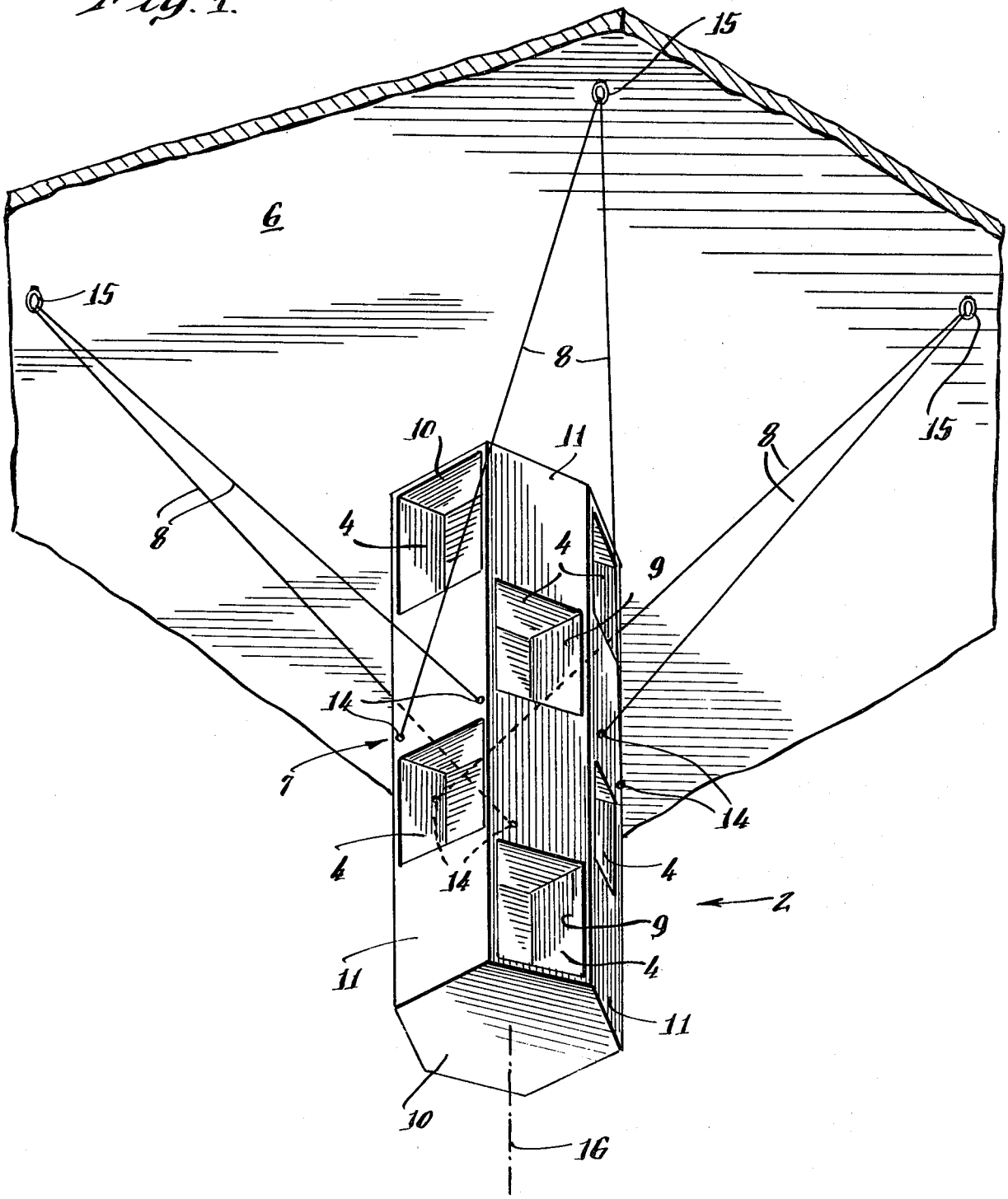
FIG. 1 illustrates in perspective the hanging storage apparatus in accordance with one aspect of the present invention.

FIGS. 1, 2, 3 and 4 illustrate a first embodiment of hanging storage compartment apparatus in accordance with the present invention. The storage compartment apparatus, generally indicated by the reference numeral 2, includes a plurality of storage shelf areas 4. In the disclosed embodiment, the storage compartment apparatus is formed as an attractive integral unit, having a hexagonal configuration in plan view, made from suitable structural material, such as wood, rigid plastic or metal, and includes four separate levels or tiers defining the respective storage shelf areas 4. Each storage area 4 has an opening in the outer surface of the storage compartment 2. Doors (not shown) may be mounted proximate to each opening to selectively open and close the entrance to each storage area, if desired by the user.

Figure 4:
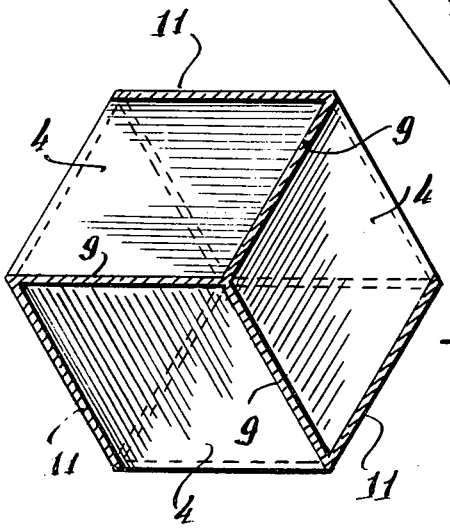
FIG. 4 is a plan sectional view taken along the line 4—4 in FIG. 2, and shown enlarged.

However, the regular hexagonal configuration with three open shelf areas 4 in each level is attractive as shown, and therefore, it is believed that most users will prefer to have the shelf openings uncovered to provide an eye-pleasing contrast with the exterior panels 11 located on each level alternating with the openings into the respective shelf areas 4. The alternating sequence of the three open shelf areas 4 and the three exterior panels 11 on each level is most clearly seen in plan cross section in FIG. 4. Thus, each of the three identical shelf areas 4 has a rhombus or diamond shape with 60° and 120° interior angles at the respective vertices as seen in FIG. 4. None of the space in each level is wasted. The three rhombic-shaped shelf areas 4 nest neatly together to form the hexagonal plan configuration of the overall unit 2. These three shelf areas are separated by the three internal partitions 9. On the next adjacent levels, the location of the shelf areas 4 and of the exterior panels 11 are shifted one-sixth of a circle, i.e., by 60°. Thus, on the next level each shelf opening is located above an exterior panel on the level below and each exterior panel is located above a shelf opening, yielding a pleasing checkerboard contrast between panels 11 and openings into the shelf areas 4. At the bottom of each level, there is a horizontal hexagonal deck 10 which forms the three respective shelves and which forms the bottom of the overall unit. There is a similar deck 10 forming the top of the unit.

Figure 2:
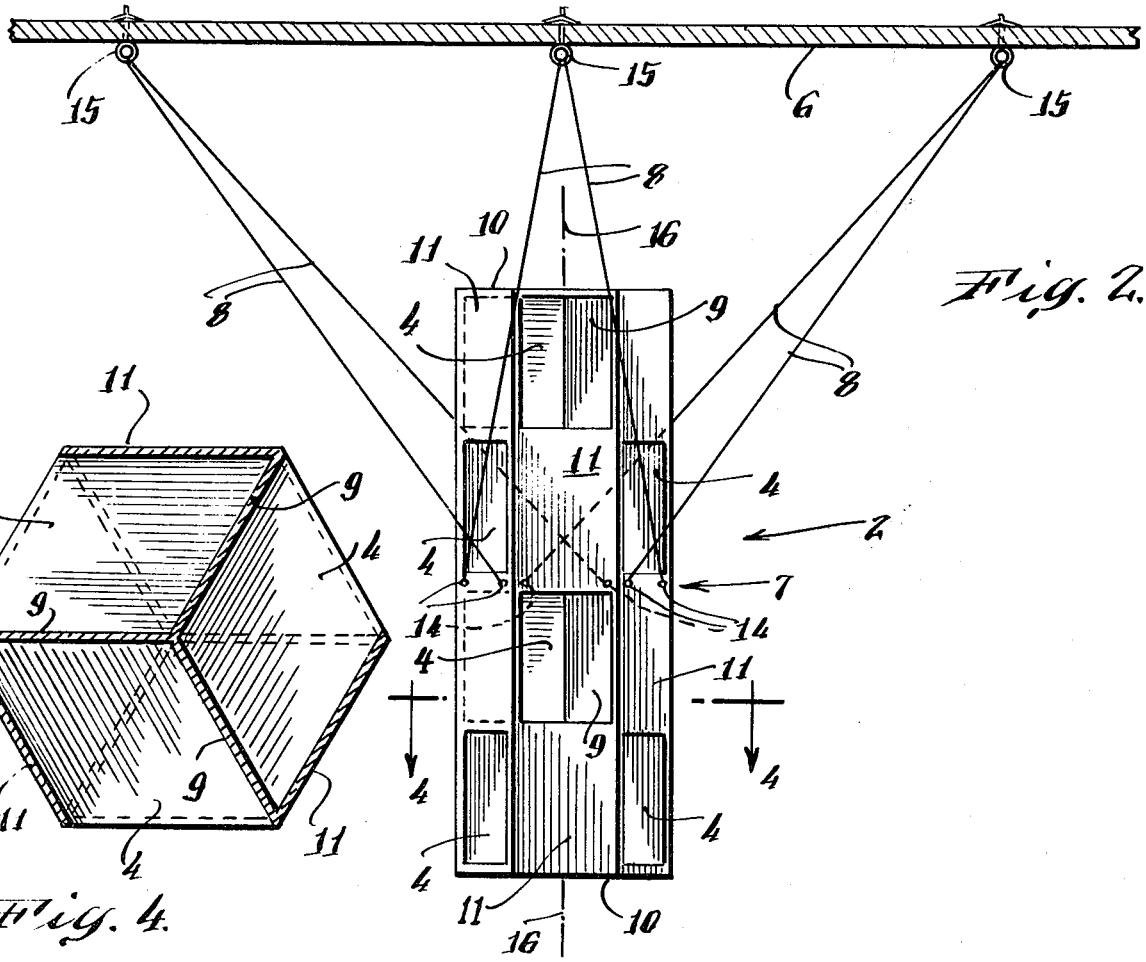
FIG. 2 is a front elevational view of the hanging storage compartment apparatus of FIG. 1, showing the storage apparatus suspending by three pairs of tension lines from a ceiling.

The storage compartment apparatus 2 is mounted to an overhead supporing structure, for example, a ceiling 6 by six tension lines 8. One end of each such tension line is secured directly to the approximate mid-level region 7 of the storage compartment 2 through suitable fastening means 14 thereon, such as screw eyes or cable clamps mounted on the apparatus 2. As illustrated in FIGS. 1 and 2, the tension lines 8 are secured to the storage compartment at the mid-level region 7, namely at the longitudinal mid-section of the apparatus 2. This longitudinal mid-section is located between the second and third tiers of storage areas 4. The other ends of each such tension line are mounted to the ceiling 6 by suitable overhead cable attachment means 15, such as screw eyes, screw hooks or eyebolts.

Figure 3:
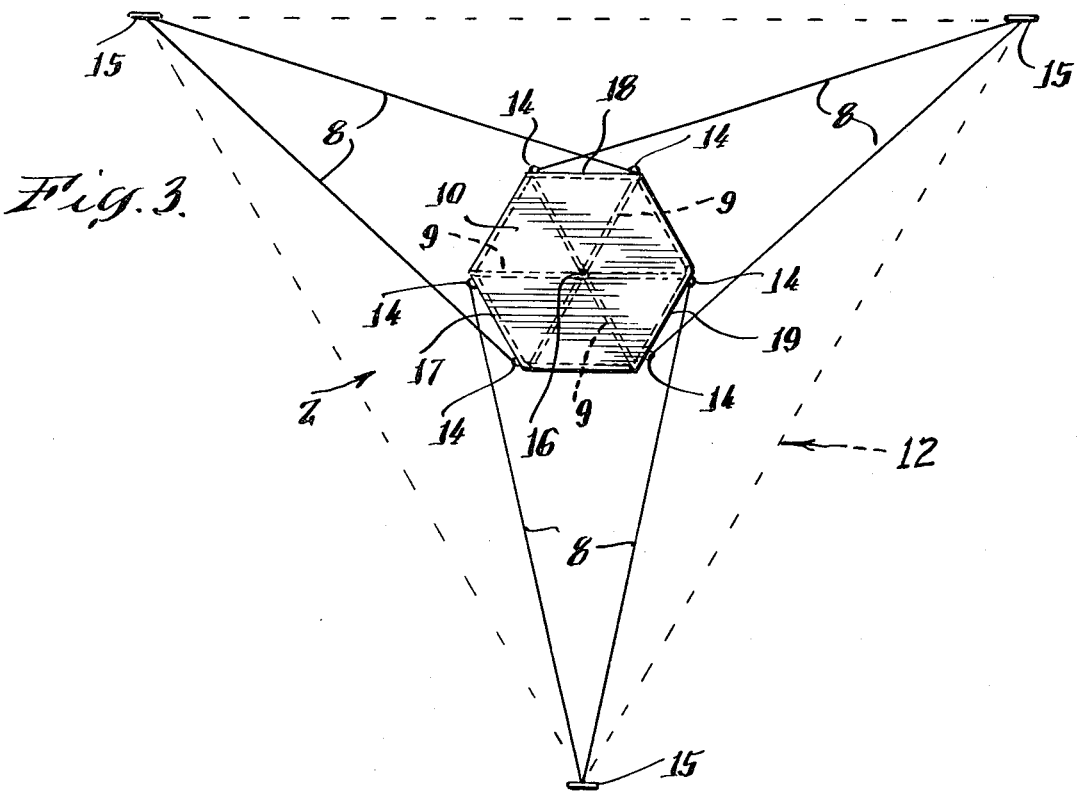
FIG. 3 is a top plan view as seen looking down on FIG. 2, showing the arrangement of the three pairs of tension lines in an equilateral triangular pattern.

FIG. 3 illustrates one arrangement in which the tension lines 8 advantageously can be used to suspend the storage compartment apparatus 2 in a very stable manner. As illustrated in FIG. 3, the storage compartment in the present embodiment of the invention has a regular hexagonal configuration as seen in plan view. The tension lines 8 are secured to the storage compartment in a three-attachment-point, six-line arrangement. Specifically, three overhead attachments 15 are mounted to the ceiling 6 and spaced apart from each other so as to define an equilateral triangle 12 therebetween. Thus, these three overhead attachments 15 are located at the respective vertices of the equilateral triangular pattern 12. Preferably, each leg of the equilateral triangle 12 is approximately 7 feet long when the tension lines 8 are used to suspend a hexagonal storage compartment apparatus 2 having a lateral expanse of approximately twenty inches. That is, the hexagonal configuration fits within a circumscribed circle having a diameter of twenty inches.

As illustrated in FIG. 3, there are a pair of the tension lines 8 secured to the ceiling by each of the attachment means 15. The pair of tension lines extend diagonally down from each of the attachments 15 to a respective pair of fasteners 14 located near diametrically opposite corners of the hexagonal midsection 7. Thus, as seen in plan view the pair of tension lines 8 extending from each attachment 15 define the two legs of a long, narrow isosceles triangle. By virtue of this isosceles triangular configuration with the pair of tension lines 8 connected to diametrically opposite fastening points 14 on the midsection level 7, the overall unit 2 is stabilized against turning about its vertical central axis 16. Also, by virtue of the fact that there are the three overhead attachment points 15 located at equilateral vertex points, namely at points spaced 120° apart around the vertical central axis 16 of the overall unit 2, it is stabilized against lateral motion or swaying motion in any direction.

The tension lines 8 extending from the opposite connections 14 on the three sides 17, 18 and 19 of the hexagon criss-cross each other and are mounted to opposed attachments 15. It is to be noted that the sides 17, 18 and 19 of the hexagon to which the tension lines 8 are fastened, are parallel to the adjacent legs of the equilateral triangle 12 defined between their respective attachment points 15. The weight of the storage compartment apparatus 2 maintains the tension lines 8 taut, and the described three-point, six-line equilateral suspension arrangement provides excellent stability for the suspended storage compartment unit 2.

The stationary storage compartment unit 2 described herein can be suspended at any convenient position in a room to provide access to all sides thereof, and as previously discussed, does not occupy valuable floor space.

FIGS. 5 and 6 illustrate a second embodiment of hanging storage compartment apparatus in accordance with the present invention. In this embodiment, the whole storage compartment apparatus, indicated generally by the reference numeral 20, includes two different units 22 and 24. These different units may be called an upper rotatable unit 22 and a lower rotatable unit 24. As in the first embodiment discussed above, the present storage compartment has a hexagonal plan shape. A suspended, stationary hexagonal ring member or platform 26 is disposed between the top deck 10 of the lower storage unit 24 and the bottom deck 10 of the upper storage unit 22. Rotation bearing means 28, for example, such as a ring of ball bearings concentric about the central vertical axis 16, are positioned between the top of the suspended platform member 26 and the bottom deck 10 of the upper storage unit 22. The peripheral shape of the suspended stationary member 26 desirably matches the plan configuration of the storage compartment, which in the disclosed embodiment, is hexagonal. If desired, the suspended stationary platform member 26 may be made circular in peripheral configuration, for providing an eye-attracting plane of demarcation between the upper and lower hexagonal rotatable units 22 and 24, respectively. Such a circular platform member 26 has a diameter at least as large as the lateral expanse or width of the apparatus 20 as measured diametrically from corner to opposite corner in order to provide clearance between the upper rotatable unit 22 and the diagonally extending tension elements 8.

This suspended stationary member 26 may be a hexagonal ring having sufficient radial area for mounting the ring bearing means 28 concentric around the vertical central axis of rotation 16.

One end of a vertical shaft 30 located in the axis 16 is rigidly affixed to the upper storage unit 22. The shaft 30 extends upwardly through the platform 26 and through the rotatable bearing means 28, and the lower end of this shaft is affixed to the lower storage unit 24. If a solid platform 26 is used instead of a ring-shaped platform, then a suitable axial opening is provided to permit free rotation of the shaft 30.

The ends of six tension lines 8 are fastened to the stationary member 26 through suitable fasteners 14 thereon. The other ends of these tension lines are mounted to an overhead supporting structure, as for example, a ceiling 6 by the attachment means 15. Preferably, a three-point, six tension line equilateral suspension arrangement is provided identical to that as described above for the unit 2 shown in FIGS. 1-4. This advantageous suspension arrangement is illustrated in FIGS. 5 and 6.

In operation, the upper and lower storage units 22 and 24 sections are rotatable relative to the stationary member 26 as a result of the rotation bearing means 28. Because the upper and lower storage compartment sections are joined together by the shaft 30, rotation of one unit relative to the stationary support simultaneously rotates the other unit a corresponding amount. Accordingly, access to all of the respective storage shelf areas 4 within both storage units 22 and 24 is facilitated by merely rotating either the upper or lower storage compartment section.

It is to be understood that each of the storage units 22 and 24 may be constructed similarly to two levels of the unit 2 shown in FIGS. 1–4, with decks 10, interior partitions 9 and exterior panels 11.

It is also within the scope of the present invention to provide rotatable storage compartment apparatus similar to that described in connection with FIGS. 5 and 6, except that both the upper and lower storage units 22 and 24 are independently rotatable. To accomplish this independent rotation, the shaft 30 is omitted and a second rotation bearing connection is provided between the upper deck 10 of the lower section 24 and the lower surface of platform member 26.

It is further within the scope of the present invention to modify the rotatable storage compartment apparatus of FIGS. 5 and 6 by eliminating either the upper unit 22 or the lower unit 24. This modification is, however, less advantageous than the apparatus 20 as shown in FIGS. 5 and 6, because less storage capacity is provided, and the symmetrical balance of the two units (upper and lower) is not achieved.

Three pairs of tension lines 8 employing three overhead attachment points 15 located at the respective vertices of an equilateral triangular pattern 12 is the preferred suspension arrangement. It is the optimum arrangement, because it provides a very stable suspension action involving the least number of tension lines 8 and the least number of attachment points 15. It is to be understood that more than six tension lines and more than three attachment points 15 can be employed, if desired. However, in my view, using more than the minimum is wasteful and not so attractive as the optimum which is described above. Furthermore, when more than the optimum number are employed, the suspension may not be so stable. For example, using four attachment points 15 and eight tension lines is not likely to be so stable as using three attachment points and six tension lines, because the precise length and tension in each line then becomes much more critical, just like the leg length of a four-legged table is more critical than the leg length of a three-legged table in achieving stability of the table.

It is understood that other modifications of the present invention may become apparent to those skilled in the art. The description of the preferred embodiments illustrated in the drawings and discussed herein are intended to be illustrative only and not restrictive of the scope of the invention, that scope being defined by the following claims and all equivalents thereto.

I claim:

1. Rotatable storage compartment apparatus adapted to be suspended from an overhead structure, said storage compartment apparatus comprising:

a supporting member having fastening means for securing at least six tension lines for suspending said supporting member from an overhead structure with said supporting member defining a vertical central axis through said supporting member, said fastening means being located near diametrically opposite points on said supporting member, said tension lines being adapted to extend diagonally upwardly from said fastening means sloping away from said vertical axis for being attached to at least three attachment means secured to said overhead structure and being spaced uniformly around said vertical axis, a first storage unit mounted above said supporting member, a second storage unit mounted below said supporting member, a vertical rotatable shaft connecting said first and second storage units, said shaft being concentric with said axis, and bearing means for permitting free rotation of said units relative to said supporting member.

2. Rotatable storage compartment apparatus as claimed in claim 1, in which:

said storage units each include at least one level of shelf areas, such a level of shelf areas includes three rhombic-shaped shelf areas as seen in plan sectional view nested together defining a regular hexagonal peripheral configuration as seen in plan view with the three respective shelf openings attractively alternating in location with three exterior panels around the periphery of said hexagonal configuration.

3. Rotatable storage compartment apparatus as claimed in claim 2, in which:

at least one of said storage units includes multiple levels of such shelf areas, and the three respective shelf openings on one level are vertically aligned with the three respective exterior panels on the next successive level and the three respective exterior panels on said one level are vertically aligned with the three respective shelf openings on the next successive level, thereby giving a pleasing checkerboard appearance of openings and panels around the hexagonal periphery of said multiple level unit.

4. Rotatable storage compartment apparatus as claimed in claim 1, 2 or 3, in which:

there are three overhead attachment means located at the vertices of an equilateral triangle concentric with said vertical axis, and a pair of tension lines extend downwardly from each such attachment means in a long narrow isosceles triangular configuration as seen in plan view with the lower ends of each pair of tension lines being connected to fastening means located near diametrically opposite points in said supporting member.

5. Rotatable storage compartment apparatus as claimed in claim 1, 2 or 3, in which:

said supporting member has a regular hexagonal peripheral shape as seen in plan view.

6. Rotatable storage compartment apparatus as claimed in claim 1, 2 or 3, in which:

said supporting member has a regular hexagonal peripheral shape as seen in plan view, there are three overhead attachment means located at the vertices of an equilateral triangle concentric with said vertical axis, and a pair of tension lines extend downwardly from each such attachment means in a long narrow isosceles triangular configuration as seen in plan view with the lower ends of each pair of tension lines being connected to fastening means located near diametrically opposite vertices of said regular hexagonal shaped supporting member.

7. An attractive shelf unit adapted to be suspended comprising:

a rigid shelf unit having a plurality of shelf levels, each level including three rhombic-shaped shelf areas as seen in plan sectional view nested together defining a regular hexagonal peripheral configuration for that level as seen in plan view, each such shelf area having an opening, the three shelf openings on each level alternating with three exterior panels on that level in sequence around the six sides of the regular hexagonal configuration of that level, and the three respective shelf openings and three respective exterior panels on the next successive levels are vertically aligned opening-with-panel and panel-with-opening with respect to the three shelf openings and three exterior panels on the preceding level, thereby giving a pleasing checkerboard appearance of openings and panels around the hexagonal periphery of said multi-level unit.

8. An attractive shelf unit as claimed in claim 7, in which:

three fastening means are secured to an overhead structure located at the vertices of an equilateral triangle concentrically located with respect to a vertical central axis passing through said shelf unit, a pair of tension lines extending downwardly and sloping inwardly from each attachment means toward said shelf unit, each pair of tension lines defining an isosceles triangle as seen in plan view, and the lower ends of each pair of tension lines being secured to said unit at a respective pair of fastening points located near diametrically opposite vertices of the hexagonal periphery of said shelf unit, said pairs of fastening points being in the same horizontal section of said shelf unit, and said tension lines suspending said shelf unit with its axis vertical and concentric with said equilateral triangle.

9. A suspended article of furniture comprising:

a rigid article of furniture having a symmetrical horizontal section including six points on said horizontal section spaced approximately uniformly about a central point in said horizontal section, six tension lines of equal length, the lower end of each tension line being secured to a respective one of said section points, three fastening points located overhead in a common plane, said three fastening points being located at the respective vertices of an equilateral triangle whose center is located over the central point of said section, and pairs of said tension lines secured to diametrically opposite section points extending upwardly in and converging with each other in an isosceles triangular pattern with their upper ends attached to the respective overhead fastening points for suspending said furniture article in a stable position.

10. A suspended article of furniture as claimed in claim 9, in which:

said horizontal section of the furniture has a regular hexagonal peripheral configuration as seen in plan view, and said six section points are located near the respective six vertices of said hexagonal configuration.

11. Rotatable storage compartment apparatus adapted to be suspended from an overhead structure, said storage compartment apparatus comprising:

a supporting member having fastening means for securing at least six tension lines at six separate positions on said supporting member for suspending said supporting member from an overhead structure with said supporting member defining a vertical central axis through said supporting member, said fastening means being located in pairs near diametrically opposite points on said supporting member and all being at the same level on said supporting member, said tension lines being adapted to extend diagonally upwardly from said fastening means sloping away from said vertical axis for being attached to at least three separate attachment means secured to said overhead structure and being spaced uniformly around said vertical axis, at least one storage unit mounted to said supporting member, and bearing means for permitting free rotation of said at least one storage unit relative to said supporting member.

* * * * *